US009403387B2

(12) United States Patent
Matsumoto et al.

(10) Patent No.: US 9,403,387 B2
(45) Date of Patent: Aug. 2, 2016

(54) RECORDING APPARATUS AND RECORDING METHOD

(71) Applicant: Seiko Epson Corporation, Tokyo (JP)

(72) Inventors: Akira Matsumoto, Shiojiri (JP); Junya Kato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/813,455

(22) Filed: Jul. 30, 2015

(65) Prior Publication Data

US 2016/0039227 A1 Feb. 11, 2016

(30) Foreign Application Priority Data

Aug. 7, 2014 (JP) ..... 2014-161044

(51) Int. Cl.
*B41J 2/01* (2006.01)
*B41J 15/04* (2006.01)
*B41J 3/60* (2006.01)

(52) U.S. Cl.
CPC ... *B41J 15/04* (2013.01); *B41J 3/60* (2013.01)

(58) Field of Classification Search
CPC ..... B41J 3/60
See application file for complete search history.

(56) References Cited

U.S. PATENT DOCUMENTS

2014/0307020 A1* 10/2014 Toriihara ..... B41J 11/663 347/16

FOREIGN PATENT DOCUMENTS

JP 08-108588 A 4/1996
JP 2012-166915 A 9/2012

OTHER PUBLICATIONS

Katsuyama, Ink-Jet Printer, Apr. 30, 1996, Japan, pp. 1-8.*

* cited by examiner

*Primary Examiner* — Matthew Luu
*Assistant Examiner* — Tracey McMillion

(57) ABSTRACT

A recording apparatus includes: a recording section that is capable of recording on a medium transferred in a transporting direction; a first unit that is capable of sending the medium from the upstream side of the transporting direction to a recording area in the recording section; and a second unit that is capable of collecting the medium sent from the recording area to the downstream side of the transporting direction, in which the first unit is capable of being moved to the downstream side of the transporting direction while the second unit is capable of being moved to the upstream side of the transporting direction, and the second unit is capable of sending the medium from the upstream side of the transporting direction to the recording area while the first unit is capable of collecting the medium sent from the recording area to the downstream side of the transporting direction.

7 Claims, 7 Drawing Sheets

RECORDING APPARATUS AND RECORDING METHOD

BACKGROUND

1. Technical Field

The present invention relates to a recording apparatus and a recording method.

2. Related Art

In the related art, recording apparatuses that record by discharging liquid including ink on a medium or the like are used. Among these apparatuses, there is a recording apparatus that records on a roll-shaped medium.

For example, in JP-A-2012-166915, a recording apparatus including a feeding means capable of sending a roll-shaped medium to a recording position and a winding means that winds a medium on which recording is performed in a roll-shape is disclosed.

Here, regarding a recording apparatus, recording on both sides of a medium is generally performed.

However, in the recording apparatus or the like including the feeding means capable of sending the roll-shaped medium to the recording position and the winding means that winds the medium on which recording is performed in a roll-shape as the apparatus according to JP-A-2012-166915, a user is required to remove the medium wound by the winding means from the winding means or the like and set the medium again on the feeding means or the like to record on both sides of a medium. In particular, in the case where a large and heavy medium is used, such operation is a severe load to the user.

SUMMARY

An advantage of some aspects of the invention is to suppress the load on the user when recording on the both sides of a medium.

According to a first aspect of the invention, there is provided a recording apparatus including: a recording section that is capable of recording on a medium transferred in a transporting direction; a first unit that is capable of sending the medium from the upstream side of the transporting direction to a recording area in the recording section; and a second unit that is capable of collecting the medium sent from the recording area to the downstream side of the transporting direction, in which the first unit is capable of being moved to the downstream side of the transporting direction while the second unit is capable of being moved to the upstream side of the transporting direction, and the second unit is capable of sending the medium from the upstream side of the transporting direction to the recording area while the first unit is capable of collecting the medium sent from the recording area to the downstream side of the transporting direction.

In the recording apparatus of a second aspect of the invention, according to the first aspect, the first unit and the second unit may be rotating bodies having a rotation axis in a direction intersecting with the transporting direction, and, in the case of using a roll-shaped medium as the medium, may be capable of sending the medium by rotating the medium and collecting the medium in a roll shape in a winding manner, respectively.

In the recording apparatus of a third aspect of the invention, according to the second aspect, at least one of the first unit and the second unit may be capable of being rotated in a first rotating direction and a second rotating direction, which is a reverse direction of the first rotating direction.

In the recording apparatus of a fourth aspect of the invention, according to any one of the first aspect to the third aspect, the first unit and the second unit may be provided on an installing section side of the recording apparatus further than the recording section.

In the recording apparatus of a fifth aspect of the invention, according to any one of the first aspect to the fourth aspect, the first unit and the second unit may linearly move sending positions of the medium at the upstream side of the transporting direction and collecting positions of the medium at the downstream side of the transporting direction.

The recording apparatus of a sixth aspect of the invention, according to the fifth aspect, may further include guide sections that guide linear movements of the sending positions and the collecting positions.

In the recording apparatus of a seventh aspect of the invention, according to any one of the first aspect to the fourth aspect, the first unit and the second unit may be capable of rotationally moving the sending positions of the medium at the upstream side of the transporting direction and the collecting positions of the medium at the downstream side of the transporting direction centering on a rotation axis in the direction interesting with the transporting direction.

According to an eighth aspect of the invention, there is provided a recording method including: first sending of a medium from the upstream side of a transporting direction of the medium to a recording area in a recording section by a first unit; first recording on a first surface of the medium sent to the recording area; first collecting of the medium in which recording is performed on the first surface from the downstream side of the transporting direction further than the recording area by a second unit; moving the first unit to the downstream side of the transporting direction while moving the second unit to the upstream side of the transporting direction; second sending of the medium from the upstream side of the transporting direction to the recording area by the second unit; second recording on a second surface, which is opposite to the first surface of the medium sent to the recording area; and second collecting of the medium in which recording is performed on the second surface in the downstream side of the transporting direction by the first unit.

According to the aspects of the invention, it is possible to suppress the load on the user when recording on the both sides of a medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the recording apparatus according to an embodiment of the invention will be described in detail with reference to the attached drawings.

First Embodiment (FIG. 1 to FIG. 4)

Figure 1:
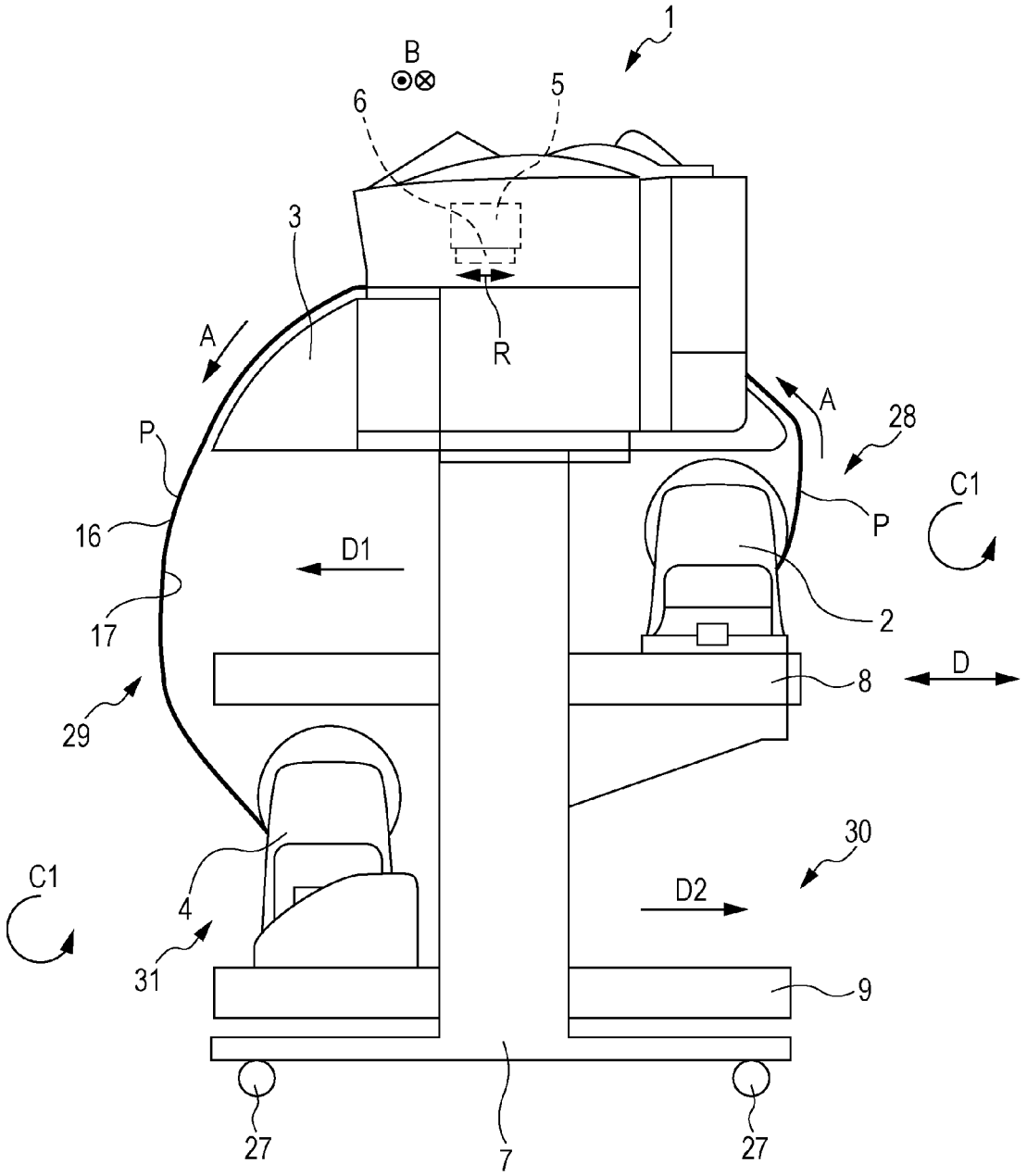
FIG. 1 is a schematic side view illustrating a recording apparatus according to a first embodiment of the invention.
Figure 2:
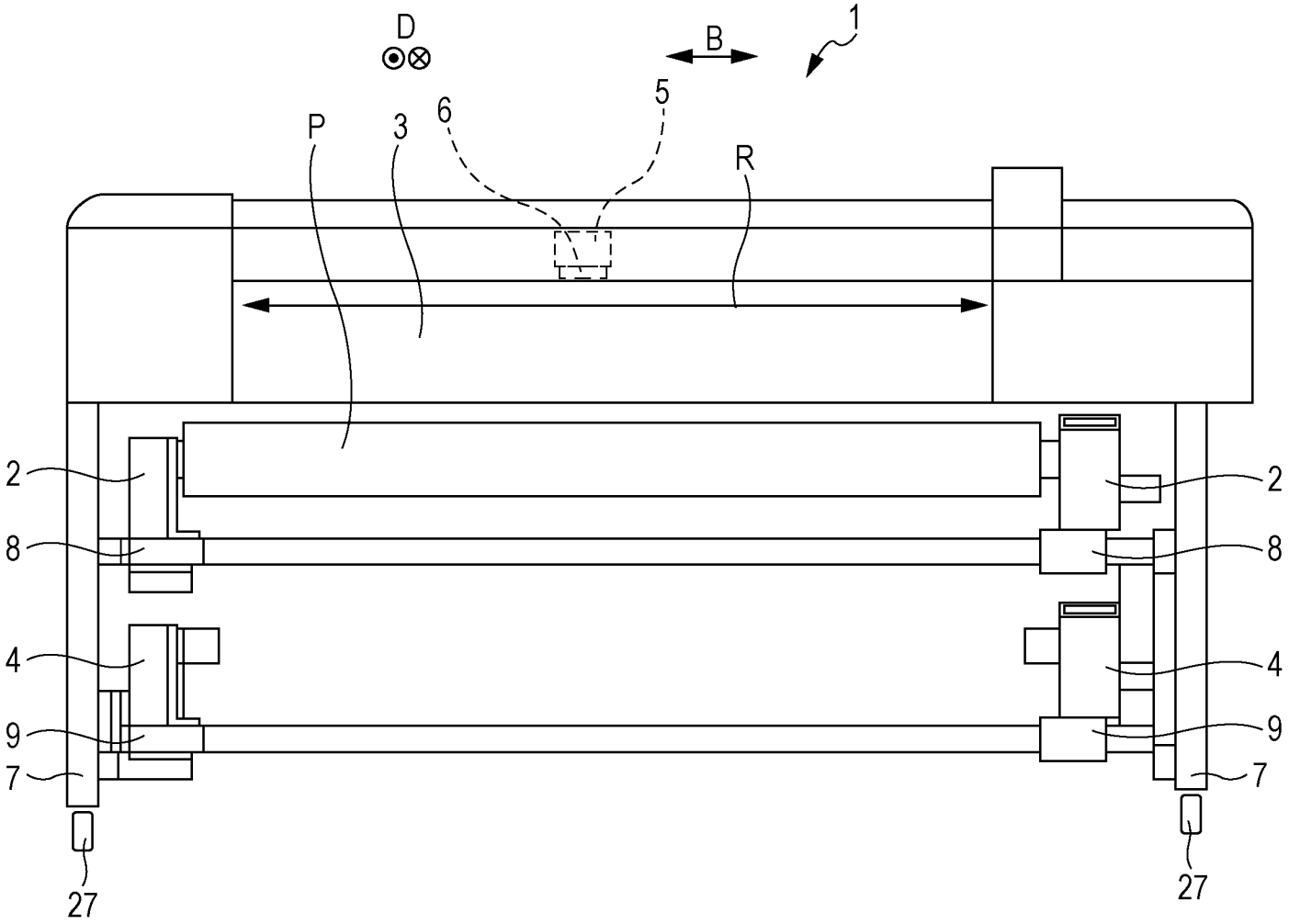
FIG. 2 is a schematic front view illustrating the recording apparatus according to the first embodiment of the invention.

FIG. 1 is a schematic side view illustrating a recording apparatus 1 according to the embodiment, and FIG. 2 is a schematic front view illustrating the recording apparatus 1 according to the embodiment. In addition, FIG. 1 illustrates a state, in which a recording medium P (medium) is set in a setting section 2, and is in a recording area R which is a discharging area of ink (liquid) (recordable state).

As illustrated in FIG. 1 and FIG. 2, the recording apparatus 1 according to the embodiment transports the recording medium P in a transporting direction A from the setting section 2 of the recording medium P as a first unit in which the recording medium P can be sent to the ink recording area R, through a platen 3 as a supporting section of the recording medium P, to a winding section 4 of the recording medium P as a second unit in which the recording medium P can be collected. In other words, a transporting route of the recording medium P in the recording apparatus 1 is from the setting section 2 to the winding section 4, and the platen 3 is the supporting section of the recording medium P provided at the transporting route. In addition, in the case of recording from the state in FIG. 1, the setting section 2 rotates the recording medium P in a rotating direction C1 as a first rotating direction and transports the recording medium P, while the winding section 4 winds the recording medium P by rotating the recording medium P in the rotating direction C1.

In other words, in the recording apparatus 1 according to the embodiment, the setting section 2 and the winding section 4 are rotation bodies with a rotation axis in a direction B, which intersects with the transporting direction A. For this, the recording apparatus has a configuration in which, in the case where the recording medium P in a roll-shape as the recording medium P are used, the recording medium P is transported by being rotated and is collected by being wound in a roll-shape.

In addition, the recording apparatus 1 according to the embodiment has a configuration in which recording can be performed on the recording medium P in a roll-shape. However, not limited to this configuration, the recording apparatus may have a configuration in which recording can be performed on the recording medium P in a cut-sheet shape. In the case of the configuration in which recording can be performed on the recording medium P in a cut-sheet shape, for example, as the setting section 2 of the recording medium P, a so-called feeding (transporting) tray or a feeding (transporting) cassette may be used. Furthermore, as a collecting section of the recording medium P and as a collecting section other than the winding section 4, for example, a so-called receiving section for discharge and a so-called sheet discharging (discharging) tray and a sheet discharging (discharging) cassette may be used.

In addition, the recording apparatus 1 according to the embodiment is capable of recording on the both sides of the recording medium P. FIG. 1 illustrates a setting state of the recording medium P, in which recording can be performed on a first surface 16, which is an outside surface of the rolled recording medium P. In the set state of the recording medium P of this case (case in which the roll is wound outwards), the setting section 2 is rotated in the rotating direction C1. Meanwhile, in the case where recording is performed on a second surface 17, which is an inside surface of the rolled recording medium P (case in which the roll is wound inwards), the setting section 2 is rotated in a rotating direction C2, which is a second rotating direction and a reverse direction of the rotating direction C1.

Therefore, similarly, as illustrated in FIG. 1, the winding section 4 according to the embodiment is in a state in which the first surface 16 of the recording medium P is wound outwards, and thus the winding section 4 is rotated in the rotating direction C1. Meanwhile, in the case where the first surface 16 is wound inwards, the rotation axis of the winding section 4 is rotated in the rotating direction C2.

In addition, in the embodiment, the outside surface of the rolled recording medium P is the first surface and the inside surface of the rolled recording medium P is the second surface. However, this correspondence relation may be in reverse. Furthermore, the first rotating direction is the rotating direction C1 and the second rotating direction is the rotating direction C2. However, this correspondence relation may be in reverse.

In addition, in the recording apparatus 1 according to the embodiment, a transporting section which is not illustrated is provided at the transporting route of the recording medium P, and the transporting section is configured by a pair of rollers having a rotation axis in the direction intersecting B that intersects with the transporting direction A. According to this configuration, in the transporting route of the recording medium P, in the recording apparatus 1 according to the embodiment, the transporting section transports the recording medium P sent from the setting section 2 to the transporting section, and the winding section 4 winds the recording medium transported to the winding section 4 by the transporting section.

In addition, the recording apparatus 1 according to the embodiment includes a recording head 6 as a recording section on the side opposing the platen 3 at the transporting route of the recording medium P. The recording apparatus 1 reciprocates the recording head 6 through a carriage 5 in the intersecting direction B while discharging ink onto the recording medium P from a nozzle forming surface of the recording head 6 to form a desired image in the recording area R. According to this configuration, it is possible for the recording head 6 as the recording section to discharge ink as liquid onto the recording medium P.

Here, it can be said that the setting section 2 is capable of sending the recording medium P from the upstream side of the transporting direction A to the recording area R of the ink in the recording head 6 based on the positional relationship between the recording head 6 and the setting section 2. In addition, it can be said that the winding section 4 is capable of collecting the recording medium P sent from the recording area R to the downstream side of the transporting direction A based on the positional relationship between the recording head 6 and the winding section 4.

Furthermore, the setting section 2 and the winding section 4 are provided on an installing section 27 side of the recording apparatus 1, which is lower than the recording head 6. As in the recording apparatus 1 according to the embodiment, in a recording apparatus with a general configuration, the installing section 27 becomes the lower side. In other words, by providing the setting section 2 and the winding section 4 on the side lower than the recording head 6, the length of raising the recording medium P becomes shorter, while placing the recording medium P on the setting section 2 and the winding section 4 and removing the recording medium P from the setting section 2 and the winding section 4 becomes facilitated.

In addition, "the installing section" means a member that, in the case in which the recording apparatus 1 is installed, contacts the floor of the space in which the recording apparatus 1 is installed.

Furthermore, the recording apparatus 1 according to the embodiment includes the recording head 6 that records by performing a reciprocal movement. However, the recording apparatus 1 may be a recording apparatus including a so-called line head that has a plurality of nozzles discharging ink in the intersecting direction B that intersects with the transporting direction A.

Here, "the line head" is a recording head used in a recording apparatus in which a nozzle area formed in the intersecting direction B that intersects with the transporting direction A of the recording medium P is provided so as to cover the entire intersecting direction B of the recording medium P, and the recording head or the recording medium P is relatively moved to form an image. In addition, the nozzle area in the intersecting direction B of the line head may be not capable of covering the entire intersecting direction B of the recording medium P corresponding with the recording apparatus.

Furthermore, the recording head 6 according to the embodiment is a recording section capable of recording by discharging ink as liquid on the recording medium P. However, not being limited to this recording section, for example, the recording head 6 may use a transfer-type recording section that records by transferring coloring material on the recording medium P.

The setting section 2 and the winding section 4 in the recording apparatus 1 according to the embodiment are configured so as to be moved. Next, the movement of the setting section 2 and the winding section 4 in the recording apparatus 1 according to the embodiment will be described by using FIG. 1, FIG. 3, and FIG. 7.

Figure 3:
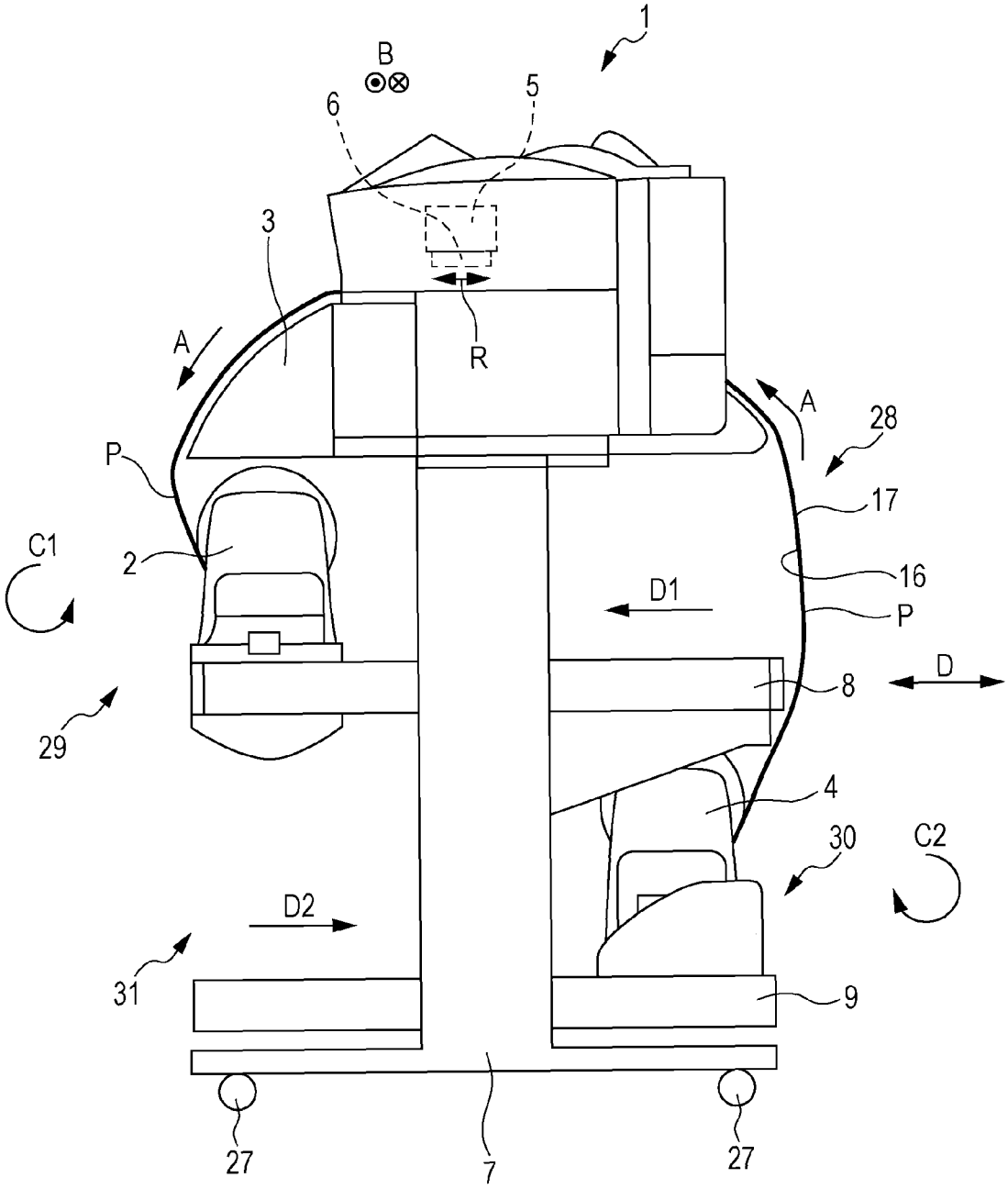
FIG. 3 is a schematic side view illustrating the recording apparatus according to the first embodiment of the invention.

Here, FIG. 3 is a schematic side view of the recording apparatus 1 according to the embodiment, which illustrates a state in which recording on the first surface 16 in the state in FIG. 1 is terminated, the setting section 2 and the winding section 4 are moved, and recording on the second surface 17 becomes possible. In addition, FIG. 7 is a schematic side view of the recording apparatus 1 of the related art, which illustrates a state in which recording on the first surface 16 is possible to be performed.

Figure 7:
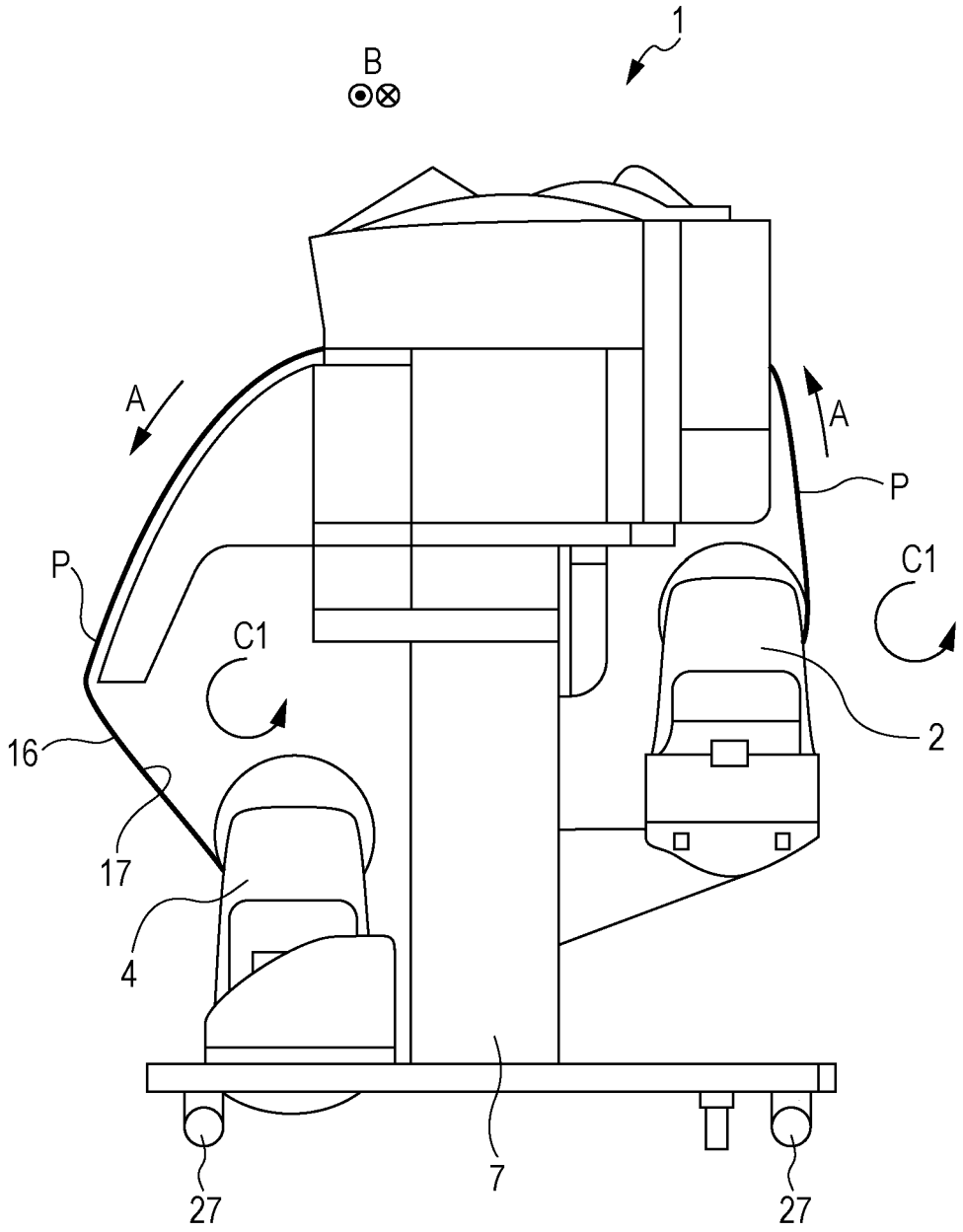
FIG. 7 is a schematic side view illustrating a recording apparatus according to the related art.

As illustrated in FIG. 7, in the recording apparatus of the related art, the setting section 2 and the winding section 4 are fixed on the recording apparatus 1. Here, in FIG. 7, an example of the recording apparatus 1 is illustrated in which the setting section 2 and the winding section 4 are fixed together to a leg section 7.

For this, in the recording apparatus 1 of the related art, after the recording on the first surface 16 is terminated, in order to record on the second surface 17, first, the rolled recording medium P wound at the winding section 4 needs to be removed from the winding section 4, moved from the front side to the rear side of the recording apparatus 1 by being lifted, and set at the setting section 2 again. Depending on the size and type of the recording medium P, there is a case in which the rolled recording medium P is heavy. When the rolled recording medium P is heavy, moving the rolled recording medium P from the winding section 4 to the setting section 2 becomes a great load to the user. For this, in the recording apparatus 1 of the related art, recording on the both sides of the heavy rolled recording medium P becomes a great load to the user.

Meanwhile, the recording apparatus 1 according to the embodiment, as illustrated in FIG. 1 and FIG. 3, the setting section 2 and the winding section 4 are movable in a direction D. More specifically, the setting section 2 is movable to the downstream side of the transporting side A by being moved in the direction D1, while the winding section 4 is movable to the upstream side of the transporting side A by being moved in the direction D2. In addition, as illustrated in FIG. 3, the winding section 4 is capable of sending the recording medium P from the upstream side of the transporting direction A to the recording area R, while the setting section 2 is capable of collecting the recording medium P sent from the recording area R to the downstream side of the transporting direction A. For this, in the case of recording on the second surface 17 of the recording medium P on which recording is performed on the first surface 16 (ink discharge) and collected by the winding section 4, moving the recording medium P from the winding section 4 to the setting section 2 can be omitted. In this manner, the recording apparatus 1 according to the embodiment has a configuration in which a load of the user when recording on the both sides of the recording medium P can be suppressed.

Here, the recording apparatus 1 according to the embodiment is, in the case of recording on the second surface 17 of the recording medium P in which recording is performed on the first surface 16 and which is wound at the winding section 4, configured so as to rotate the recording medium P in the rotating direction C2 when sending the recording medium P from the winding section 4. In this manner, it is possible to discharge ink onto a surface of the side opposite to the surface on which ink was previously discharged by making it possible to rotate at least one of the setting section 2 and the winding section 4 in the rotating direction C1, which is the first rotating direction, and in the rotating direction C2, which is the second rotating direction, without reversing the recording medium P along with moving the winding section 4 from the downstream side of the transporting direction A to the upstream side or moving the setting section 2 moved to the downstream again to the upstream side. Removing the recording medium P from the setting section 2 and the winding section 4 and reversing the medium is a load to the user, and thus there are many cases in which it is difficult to provide reversing equipment of the setting section 2 and the winding section 4 on the recording apparatus 1. For this reason, it is preferable to configure so as to rotate at least one of the setting section 2 or the winding section 4 in the rotating direction C1, which is the first rotating direction, and in the rotating direction C2, which is the second rotating direction.

In addition, as illustrated in FIG. 1 and FIG. 3, the setting section 2 and the winding section 4 are configured so as to linearly move sending positions 28 and 30 of the recording medium P on the upstream side of the transporting direction A and collecting positions 29 and 31 of the recording medium P on the downstream side of the transporting direction A in the direction D in a state guided by guiding sections 8 and 9. According to this configuration, moving the setting section 2 and the winding section 4 becomes facilitated.

Here, it is possible to linearly move the setting section 2 and the winding section 4 according to the embodiment in the direction D, and to fix the setting section 2 and the winding section 4 to a plurality of positions. As for fixing places, a configuration in which the sections are fixed to a plurality of positions at equal intervals in the direction D, or fixed to a certain position in the direction D may be used, without specific limitations.

Next, the electric configuration of the recording apparatus 1 according to the embodiment will be described.

Figure 4:
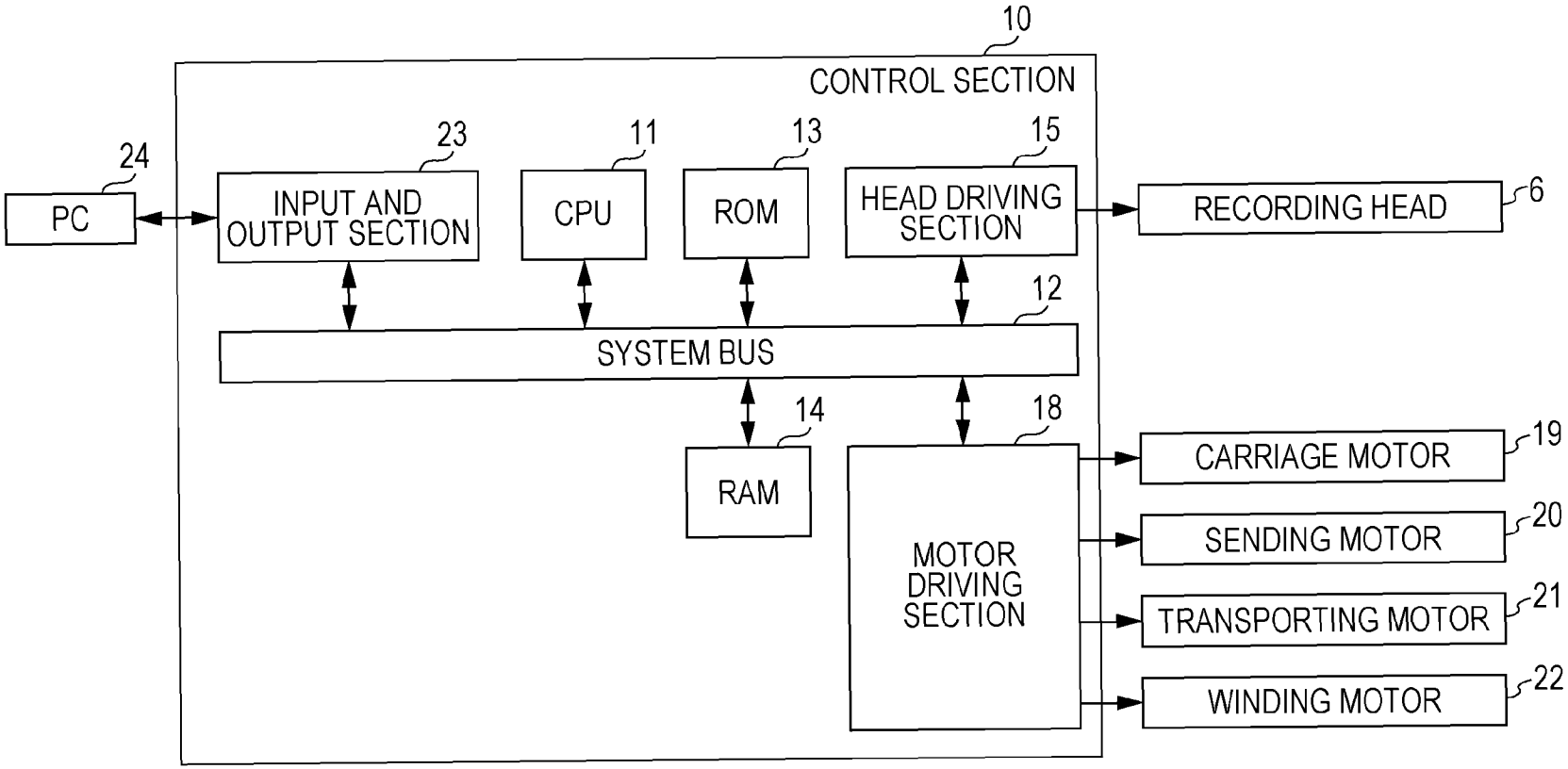
FIG. 4 is a block diagram illustrating the recording apparatus according to the first embodiment of the invention.

FIG. 4 is a block diagram of the recording apparatus 1 according to the embodiment.

In a control section 10, a CPU 11 is provided which is in charge of controlling the entire recording apparatus 1. The CPU 11 is connected through a system bus 12 to a ROM 13 storing various control programs executed by the CPU 11 and to a RAM 14 which is capable of storing data temporarily.

In addition, the CPU 11 is connected through the system bus 12 to a head driving section 15 for driving the recording head 6.

Furthermore, the CPU 11 is connected through the system bus 12 to a motor driving section 18 for driving a carriage motor 19 for moving a carriage 5, a sending motor 20, which is a driving source of the setting section 2, a transporting motor 21, which is a driving source of a driving roller in the pair of rollers configuring the transporting section, and a winding motor 22, which is a driving source of the winding section 4.

Furthermore, the CPU 11 is connected through the system bus 12 to an input and output section 23, which is connected to a PC 24, which is an outside apparatus inputting recording data or the like to the recording apparatus 1.

In addition, the recording apparatus 1 according to the embodiment is, when moving the setting section 2 and the winding section 4, configured so as for the user to move the setting section 2 and the winding section 4 by manually sliding the setting section 2 and the winding section 4. However, the recording apparatus 1 may be configured so as to automatically move the setting section 2 and the winding section 4 by providing a moving mechanism capable of automatically moving the setting section 2 and the winding section 4 and by controlling the moving mechanism from the control section 10.

Figure 5:
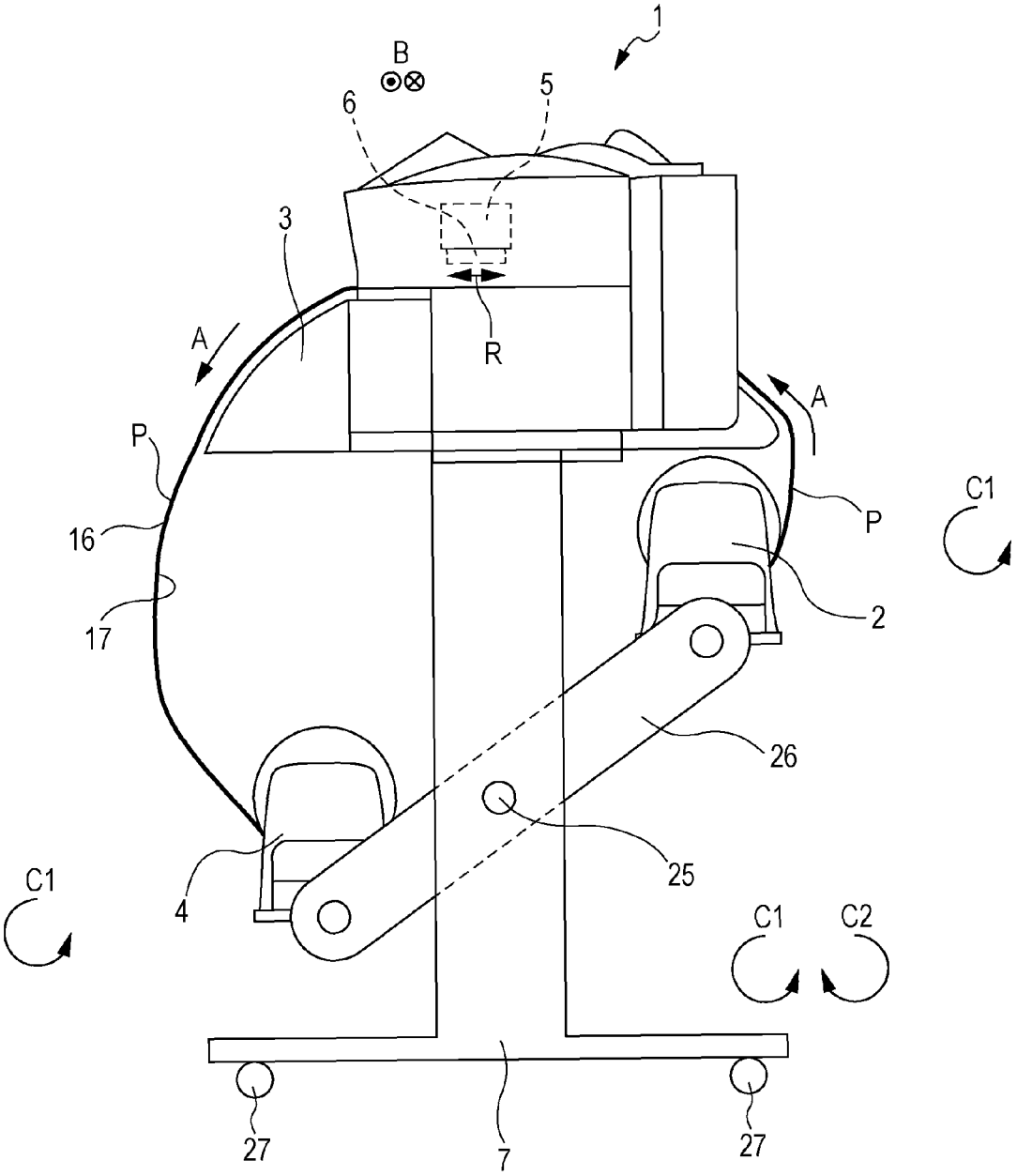
FIG. 5 is a schematic side view illustrating a recording apparatus according to a second embodiment of the invention.

Second Embodiment 2 (FIG. 5)

Next, the recording apparatus according to a second embodiment will be described in detail with reference to the attached drawings.

FIG. 5 is a schematic side view illustrating a recording apparatus 1 according to the embodiment. In addition, components shared with the embodiment 1 are illustrated with the same symbols, and thus the description thereof will be omitted.

Furthermore, the recording apparatus 1 according to the embodiment has the same configuration as the recording apparatus 1 according to the embodiment 1, except for the configuration of a moving mechanism for the setting section 2 and the winding section 4.

The moving mechanism for the setting section 2 and the winding section 4 according to the recording apparatus 1 of the first embodiment was configured so as to linearly move the setting section 2 and the winding section 4 in the direction D. Meanwhile, a moving mechanism for a setting section 2 and the winding section 4 according to the recording apparatus 1 of the embodiment is configured by a turret section 26 including a rotation axis 25 extending in an intersecting direction B. The setting section 2 and the winding section 4 are provided in the turret section 26, and, by rotating the turret section 26 in a rotating direction C1 and a rotating direction C2 centering on the rotation axis 25, can simply move sending positions 28 and 30 of a recording medium P at the upstream side of a transporting direction A and collecting positions 29 and 31 of recording medium P at the downstream side of the transporting direction A.

In addition, since it is possible to move the setting section 2 and the winding section 4 at the same time, it is possible to decrease the load on the user when moving the setting section 2 and the winding section 4.

Here, the turret section 26 according to the embodiment can be rotationally moved in the rotating direction C1 and the rotating direction C2, and be fixed in a plurality of angles (angle with regard to a leg section 7). As for fixing angles, a configuration in which the turret section is fixed at a plurality of angles at equal intervals in the rotating direction C1 and the rotating direction C2, or fixed at a certain angle in the rotating direction C1 and the rotating direction C2 may be used, without specific limitations.

Figure 6:
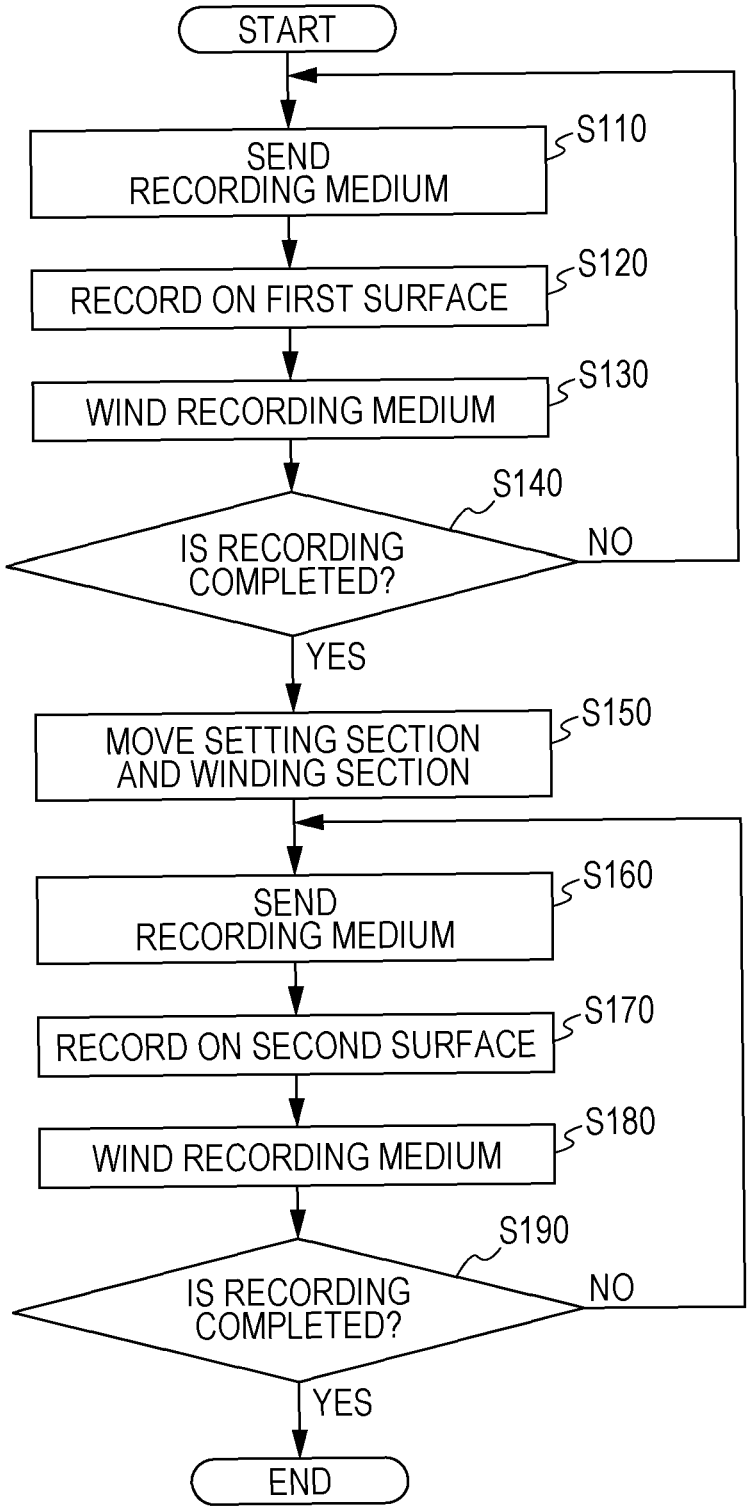
FIG. 6 is a flowchart illustrating a recording method according to an embodiment of the invention.

Embodiment of Recording Method (FIG. 6)

Next, an embodiment of a recording method using the recording apparatus 1 according to the first embodiment will be described.

FIG. 6 is a flowchart of a recording method according to the embodiment.

If the user sets the recording medium P on the recording apparatus 1 in the state illustrated in FIG. 1 and the control section 10 inputs recording data for recording on the first surface 16 of the recording medium P from the PC 24, in the recording apparatus 1 of the first embodiment, the setting section 2 initially sends the recording medium P by a sending process (first sending process) of the recording medium P of a step S110. More specifically, the setting section 2 sends a desired place for landing the ink on the recording medium P to a recording area R by sending the recording medium P from the upstream side of the transporting direction A of the recording medium P to the recording area R, which is an ink discharging area.

Next, in a recording process (first recording process) on the first surface 16 of a step S120, ink is discharged from the recording head 6 onto the desired place of the first surface 16 of the recording medium P sent to the recording area R.

Next, in a winding process (first collecting process) of the recording medium P of a step S130, the recording medium P in which ink is discharged onto the first surface 16 is wound and collected from the downstream side of the transporting direction A further than the recording area R by the winding section 4.

Next, in a first recording termination determination process of a step S140, it is determined whether recording is terminated based on recording data for recording on the first surface 16. In addition, the process is repeated from the step S110 to the step S140 until it is determined that the recording is terminated based on the recording data, and the process proceeds to a step S150 when it is determined that the recording is terminated based on the recording data.

If the recording is terminated based on the recording data for recording on the first surface 16, the user moves the setting section 2 and the winding section 4 in a moving process (unit moving process) of the setting section 2 and the winding section 4 of the step S150. More specifically, the user moves the setting section 2 from a sending position 28 at the upstream side of the transporting direction A to a collecting position 29 at the downstream side by linearly moving the setting section 2 in a direction D1, while moving the winding section 4 from a collecting position 31 at the downstream side of the transporting direction A to a sending position 30 at the upstream side by linearly moving the winding section 4 in a direction D2.

Next, the user sets the recording medium P on the recording apparatus 1 in the state illustrated in FIG. 3, the control section inputs recording data for recording on the second surface 17 of the recording medium P to the control section 10 from the PC 24, and, in a sending process (second sending process) of the recording medium P of a step S160, the winding section 4 sends a desired place for landing the ink on the recording medium P to a recording area by sending the recording medium P from the upstream side of the transporting direction A of the recording medium P to the recording area R, in which ink is recorded.

Next, in a recording process (second recording process) on the second surface 17 of a step S170, ink is discharged from the recording head 6 at the desired place of the second surface 17 of the recording medium P sent to the recording area R.

Next, in a winding process (second collecting process) of the recording medium P of a step S180, the recording medium P in which ink is discharged onto the second surface 17 is wound and collected from the downstream side of the transporting direction A further than the recording area R by the setting section 2.

Next, in a second recording termination determination process of a step S190, it is determined whether recording is terminated based on recording data for recording on the second surface 17. In addition, the process is repeated from the step S160 to the step S190 until it is determined that the recording is terminated based on the recording data, and the recording method according to the embodiment is terminated when it is determined that the recording is terminated based on the recording data.

In the recording method according to the embodiment, the setting section 2 is moved to the downstream side of the transporting direction A while the winding section 4 is moved to the upstream side of the transporting direction A, the recording medium P is sent to the recording area R from the upstream side of the transporting direction A by the winding section 4, and ink is discharged (recorded) onto the second surface 17 of the recording medium P sent to the recording area R. For this reason, in the case of discharging ink on the second surface 17 of the recording medium P in which ink is discharged onto the first surface 16 and which is collected by the winding section 4, moving the recording medium P from the winding section 4 to the setting section 2 can be omitted. In doing so, it is possible to suppress the load on the user when discharging ink on the both sides of the recording medium P.

In addition, without limiting the invention to the embodiments, various changes can be applied within the scope of the invention described in the aspects of the invention, and also, the changes can be included in the scope of the invention.

In the above, the invention is described based on the detailed embodiments. Here, the invention will be described in summary once again.

The recording apparatus 1 of the first aspect of the invention includes, in the medium P transported in the transporting direction A, the recording section 6 in which recording can be performed, the first unit 2 in which the medium P is capable of being sent to the recording area R in the recording section 6 from the upstream side of the transporting direction A, and the second unit 4 in which the medium P sent to the downstream side of the transporting direction A from the recording area R is capable of being collected, in which the first unit 2 is capable of being moved to the downstream side of the transporting direction A while the second unit 4 is capable of being moved to the upstream side of the transporting direction A, and the second unit 4 is capable of collecting the medium P sent from the upstream side of the transporting direction A to the recording area R while the first unit 2 is capable of sending the medium P from the recording area R to the downstream side of the transporting direction A.

According to the aspect, the first unit 2 is capable of being moved to the downstream side of the transporting direction A while the second unit 4 is capable of being moved to the upstream side of the transporting direction A. Therefore, the second unit 4 can the winding section 4 is capable of sending the medium P from the upstream side of the transporting direction A to the recording area R, while the setting section 2 is capable of collecting the medium P sent from the recording area R to the downstream side of the transporting direction A. For this reason, in the case of recording on the second surface 17 of the medium P on which recording is performed on the first surface 16 and collected by the second section 4, moving the medium P from the second unit 4 to the first unit 2 can be omitted. Therefore, it is possible to suppress the load on the user when recording on the both sides 16 and 17 of the medium P.

In the recording apparatus 1 of the second aspect of the invention, according to the first aspect, the first unit 2 and the second unit 4 are rotating bodies having the rotation axis in the direction B intersecting with the transporting direction A, and in the case of using the roll-shaped medium P as the medium P, are capable of sending the medium by rotating the medium and collecting the medium in the roll shape in the winding manner, respectively.

According to the aspect, the first unit 2 and the second unit 4 are rotating bodies having the rotation axis in the direction B intersecting with the transporting direction A, and in the case of using the roll-shaped medium P, are capable of sending the medium by rotating the medium and collecting the medium in the roll shape in the winding manner, respectively. For this reason, in the case of recording on the second surface 17 of the medium P in which recording is performed on the first surface 16 and which is collected by the second unit 4 using the roll-shaped medium P, moving the medium P from the second unit 4 to the first unit 2 can be omitted.

In the recording apparatus 1 of the third aspect of the invention, according to the second aspect, at least one of the first unit 2 and the second unit 4 can be rotated in the first rotating direction C1 (C2) and the second rotating direction C2 (C1) opposite to the first rotating direction C1 (C2).

According to the aspect, at least one of the first unit 2 and the second unit 4 can be rotated in the first rotating direction C1 (C2) and the second rotating direction C2 (C1). For this reason, when moving the second unit 4 from the downstream side of the transporting direction A to the upstream side and when moving the first unit 2 moved to the downstream side again to the upstream side, it is possible to record on the surface 17 (16) opposite to the surface 16 (17) on which recording was previously performed, without reversing the medium P.

In the recording apparatus 1 of the fourth aspect of the invention, according to any one of the first aspect to the third aspect, the first unit 2 and the second unit 4 can be installed on the installing section 27 side of the recording apparatus 1 further than the recording section 6.

Here, "the installing section" means the member that, in the case in which the recording apparatus 1 is installed, contacts the floor of the space in which the recording apparatus 1 is installed.

According to the aspect, the first unit and the second unit 4 are provided on the installing section 27 side of the recording apparatus 1 further than the recording section 6. In other words, in the recording apparatus 1 of the general configuration in which the lower side is the installing section 27, the first unit 2 and the second unit 4 are provided on the side lower than the recording section 6, the length of lifting the medium P can be decreased, and placing the medium P on the first unit 2 and the second unit 4 and removing the medium P on the first unit 2 and the second unit 4 become facilitated.

In the recording apparatus 1 of the fifth aspect of the invention, according to any one of the first aspect to the fourth aspect, the first unit 2 and the second unit 4 linearly move the sending positions 28 and 30 at the upstream side of the transporting direction A of the medium P and the collecting positions 29 and 31 of the medium P at the downstream side of the transporting direction A.

According to the aspect, it is possible to simply move the first unit and the second unit by linearly moving the sending positions 28 and 30 and the collecting positions 29 and 31.

The recording apparatus 1 of the sixth aspect of the invention, according to the fifth aspect, further includes guide sections 8 and 9 that guide linear movements of the sending positions 28 and 30 and the collecting positions 29 and 31.

According to the aspect, the recording apparatus 1 includes the guide sections 8 and 9 that guide the linear movements of the sending positions 28 and 30 and the collecting positions 29 and 31. For this reason, it is possible to facilitate the movements of the first unit 2 and the second unit 4.

In the recording apparatus 1 of the seventh aspect of the invention, according to any one of the first aspect to the fourth aspect, the first unit 2 and the second unit 4 can rotationally move the sending positions 28 and 30 of the medium P at the upstream side of the transporting direction A and the collecting positions 29 and 31 of the medium P at the downstream side of the transporting direction A centering on the rotation axis 25 in the direction B intersecting with the transporting direction A.

According to the aspect, it is possible to simply move the first unit 2 and the second unit 4 by rotationally moving the sending positions 28 and 30 and the collecting positions 29 and 31.

The recording method of the eight aspect of the invention includes the first sending process of sending the medium P from the upstream side of the transporting direction A of the medium P to the recording area R in the recording section 6 by the first unit 2, the first recording process of recording on the first surface 16 of the medium P sent to the recording area R, the first collecting process of collecting the medium P in which recording is performed on the first surface 16 from the downstream side of the transporting direction A further than the recording area R by the second unit 4, the unit moving process of moving the first unit 2 to the downstream side of the transporting direction A while moving the second unit 4 to the upstream side of the transporting direction A, the second sending process of sending the medium P from the upstream side of the transporting direction A to the recording area R by the second unit 4, the second recording process of recording on the second surface 17, which is opposite to the first surface 16 of the medium P sent to the recording area R, and the second collecting process of collecting the medium P in which recording is performed on the second surface 17 on the downstream side of the transporting direction A by the first unit 2.

According to the aspect, the first unit 2 is moved to the downstream side of the transporting direction A while the second unit 4 is moved to the upstream side of the transporting direction A, the medium P is sent to the recording area R from the upstream side of the transporting direction A by the second unit 4, and recording is performed on the second surface 17 of the medium P sent to the recording area R.

For this reason, in the case of recording on the second surface 17 of the medium P in which recording is performed on the first surface 16 and which is collected by the second unit 4, moving the medium P from the second unit 4 to the first unit 2 can be omitted. Therefore, it is possible to suppress the load on the user when recording on the both sides 16 and 17 of the medium P.

The entire disclosure of Japanese Patent Application No. 2014-161044 filed Aug. 7, 2014 is expressly incorporated by reference herein.

What is claimed is:

1. A recording apparatus comprising:

a recording section that is capable of recording on a medium transferred in a transporting direction;

a first unit that is capable of sending the medium from the upstream side of the transporting direction to a recording area in the recording section; and a second unit that is capable of collecting the medium sent from the recording area to the downstream side of the transporting direction, wherein the first unit is capable of being moved to the downstream side of the transporting direction while the second unit is capable of being moved to the upstream side of the transporting direction, and the second unit is capable of sending the medium from the upstream side of the transporting direction to the recording area while the first unit is capable of collecting the medium sent from the recording area to the downstream side of the transporting direction;

wherein the first unit and the second unit are capable of rotationally moving between the upstream and downstream sides of the transporting medium, the rotation being centered on a rotation axis extending in a direction that intersects the transporting direction.

2. The recording apparatus according to claim 1, wherein the first unit and the second unit are rotating bodies having a rotation axis in a direction intersecting with the transporting direction, and, in the case of using a roll-shaped medium as the medium, are capable of sending the medium by rotating the medium and collecting the medium in a roll shape in a winding manner, respectively.

3. The recording apparatus according to claim 2, wherein at least one of the first unit and the second unit is capable of being rotated in a first rotating direction and a second rotating direction, which is a reverse direction of the first rotating direction.

4. The recording apparatus according to claim 1, wherein the first unit and the second unit are provided on an installing section side of the recording apparatus further than the recording section.

5. A recording apparatus comprising:

a recording section that is capable of recording on a medium transferred in a transporting direction;

a first unit that is capable of sending the medium from the upstream side of the transporting direction to a recording area in the recording section; and a second unit that is capable of collecting the medium sent from the recording area to the downstream side of the transporting direction, wherein the first unit is capable of being moved to the downstream side of the transporting direction while the second unit is capable of being moved to the upstream side of the transporting direction, and the second unit is capable of sending the medium from the upstream side of the transporting direction to the recording area while the first unit is capable of collecting the medium sent from the recording area to the downstream side of the transporting direction;

wherein the first unit and the second unit linearly move sending positions of the medium at the upstream side of the transporting direction and collecting positions of the medium at the downstream side of the transporting direction.

6. The recording apparatus according to claim 5, further comprising:

guide sections that guide linear movements of the sending positions and the collecting positions.

7. A recording method comprising:

first sending of a medium from the upstream side of a transporting direction of the medium to a recording area in a recording section by a first unit;

first recording on a first surface of the medium sent to the recording area;

first collecting of the medium in which recording is performed on the first surface from the downstream side of the transporting direction further than the recording area by a second unit;

moving the first unit to the downstream side of the transporting direction while moving the second unit to the upstream side of the transporting direction;

second sending of the medium from the upstream side of the transporting direction to the recording area by the second unit;

second recording on a second surface, which is opposite to the first surface of the medium sent to the recording area; and second collecting of the medium in which recording is performed on the second surface in the downstream side of the transporting direction by the first unit.

* * * * *